US006949027B1

(12) United States Patent
Habing et al.

(10) Patent No.: US 6,949,027 B1
(45) Date of Patent: Sep. 27, 2005

(54) GARDEN SWING

(75) Inventors: Theodore G. Habing, Tustin, CA (US); Carlos Gonzalez, South Gate, CA (US)

(73) Assignee: Dream Visions LLC, Tustin, CA (US)

( * ) Notice: Subject to any disclaimer, the term of this patent is extended or adjusted under 35 U.S.C. 154(b) by 0 days.

(21) Appl. No.: 10/752,356

(22) Filed: Jan. 5, 2004

(51) Int. Cl.[7] ..... A63G 9/12
(52) U.S. Cl. ..... 472/118; 472/125; 297/273
(58) Field of Search ..... 472/118–125; 297/273, 68, 423.2

(56) References Cited

U.S. PATENT DOCUMENTS

| | | | | | |
|---|---|---|---|---|---|
| 531,472 | A | | 12/1894 | Shorey | |
| 725,396 | A | | 4/1903 | Bausman | |
| 862,686 | A | | 8/1907 | Wallace | |
| 2,480,300 | A | * | 8/1949 | Luketa | 297/423.2 |
| 2,710,650 | A | * | 6/1955 | Sowder | 297/257 |
| 3,295,885 | A | * | 1/1967 | Barksdale | 297/84 |
| 3,825,299 | A | | 7/1974 | Gaucher | |
| 4,364,603 | A | * | 12/1982 | Johnson | 297/84 |
| 5,154,672 | A | * | 10/1992 | Brown | 472/118 |
| 5,803,818 | A | * | 9/1998 | Tseng | 472/118 |
| 5,902,187 | A | | 5/1999 | Boring | |
| 6,001,021 | A | * | 12/1999 | Battaglia | 472/118 |
| 6,348,005 | B1 | * | 2/2002 | Tseng | 472/118 |
| 6,547,328 | B2 | | 4/2003 | Liu | |
| 6,585,319 | B2 | * | 7/2003 | Tseng | 297/281 |
| 6,802,783 | B1 | * | 10/2004 | Tseng | 472/118 |
| 6,827,650 | B1 | * | 12/2004 | Tseng | 472/125 |

* cited by examiner

*Primary Examiner*—Kien Nguyen
(74) *Attorney, Agent, or Firm*—Blakely Sokoloff Taylor & Zafman LLP

(57) ABSTRACT

A garden swing has a fixed support structure and a seat support frame pivotally suspended from the support structure. The seat support frame is suspended on a single pivot axis so as to provide simple pendular motion. At least one seat is attached the seat support frame, the seat having a seating portion and a backrest portion. In one embodiment, the seat includes a moveable leg rest having a stowed position beneath the seating portion of the seat and an extended position forward of the seating portion of the seat. In another embodiment of the invention, the backrest portion of the seat is pivotally coupled to the seating portion of the seat so as to be positionable at a selected angle of recline.

20 Claims, 12 Drawing Sheets

GARDEN SWING

BACKGROUND OF THE INVENTION

1. Field of the Invention

This invention relates generally to the field of amusement devices and, more particularly, to a garden swing that provides simple pendular motion.

2. Background

The use of garden swings and gliders is a popular leisure activity. Many different designs for such devices have been proposed over the years. Most such devices have a relatively complicated articulated structure. Few devices provide simple pendular motion.

SUMMARY OF THE INVENTION

The present invention provides a garden swing with a fixed support structure and a seat support frame pivotally suspended from the support structure. The seat support frame is suspended on a single pivot axis so as to provide simple pendular motion. At least one seat is attached the seat support frame, the seat having a seating portion and a backrest portion. In one embodiment, the seat includes a moveable leg rest having a stowed position beneath the seating portion of the seat and an extended position forward of the seating portion of the seat. In another embodiment of the invention, the backrest portion of the seat is pivotally coupled to the seating portion of the seat so as to be positionable at a selected angle of recline.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
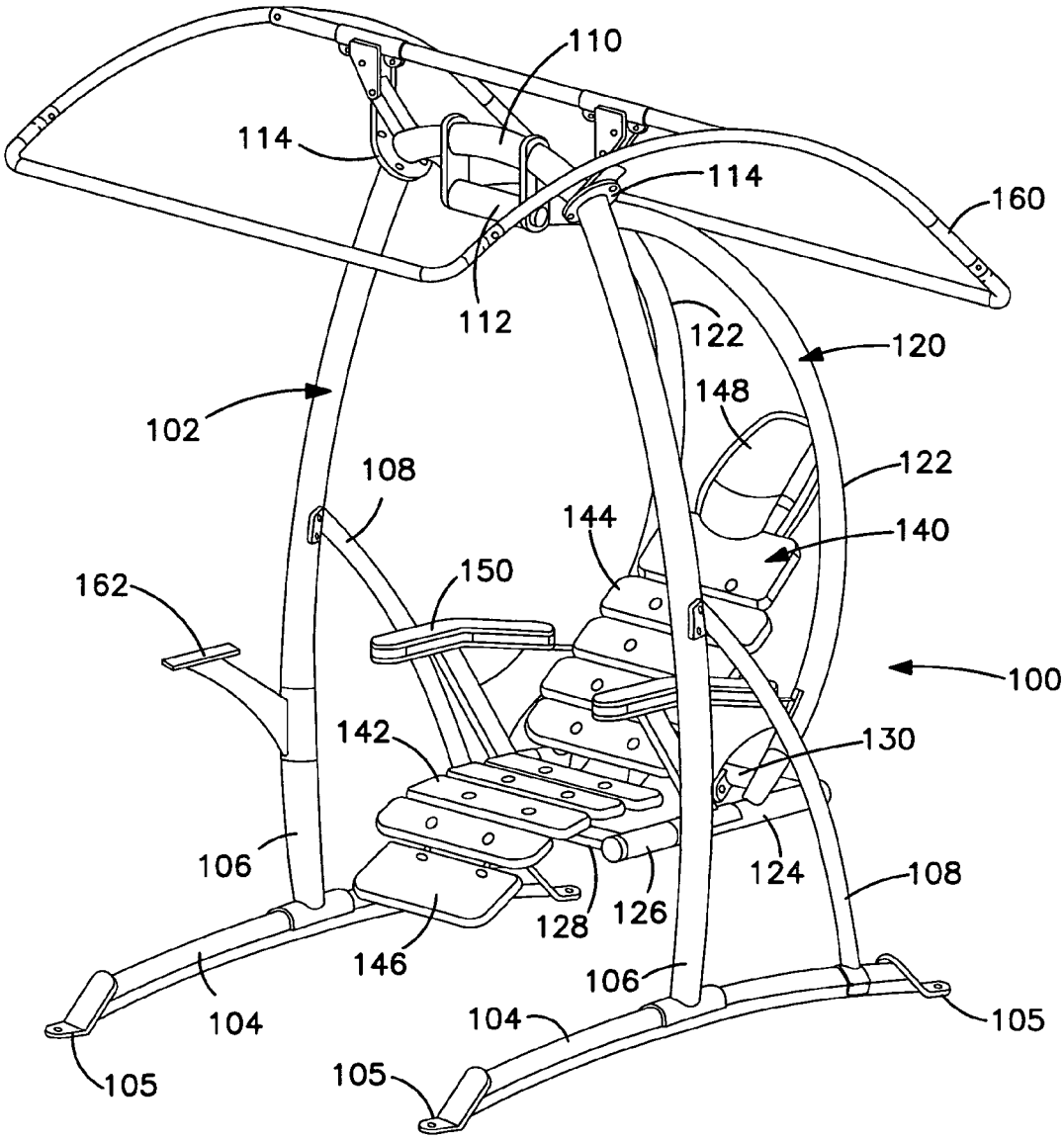
FIG. 1 is a perspective view of one embodiment of a swing constructed in accordance with the present invention.

FIG. 1 illustrates a one person swing 100 constructed in accordance with the present invention. Swing 100 has a fixed support structure 102 comprising runners 104 and generally upright members 106. Diagonal members 108 are connected between runners 104 and upright members 106 to provide added stability. Runners 104 have feet 105 at each end thereof for resting on a ground surface. Feet 105 may be provided with holes throughout so that swing 100 may be secured to a supporting surface with bolts. Fixed support structure 102 further comprises a top member 110 to which pivot assembly 112 is attached. The upper ends of upright members 106 and the ends of top member 110 have cooperating flanges 114 that are secured to one another with bolts or similar mechanical fasteners. This construction allows the side members comprising runners 104, upright members 106 and diagonal bracing members 108 to be used for the fixed support structures of a variety of configurations of swings by simply substituting different top members.

The structural members of support structure 102 are preferably fabricated of tubular steel or aluminum. Other materials, including composite materials, such as fiberglass, may also be used. The structural members may be assembled with mechanical fasteners, with welded joints or a combination of the two. The use of mechanical fasteners to join major assemblies of the structural components allows for a more compact shipping configuration.

Seat support frame 120 is suspended from pivot assembly 112. Seat support frame 120 comprises arcuate side members 122 and bottom frame 124. The bottom frame includes side members 126, forward cross member 128 and rear cross member 130.

Seat 140 is attached to seat support frame 120. The seat comprises seating portion 142 and backrest portion 144. The seat further comprises a leg rest 146 extending forward of seating portion 142 and a head rest 148 attached to the back rest portion 144. Arm rests 150 are attached to seat support frame 120 on either side of seat 140.

Seat 140 may be constructed of a plurality of pieces of wood, metal or a plastic material. Alternatively, seating portion 142 and backrest portion 144 may each comprise a single molded component, which may include cushioning if desired. Such components may be upholstered with suitable materials, such as cloth, leather or imitation leather. Seat portion 142 and backrest portion 144 may also be constructed using other materials that are commonly used for lawn furniture, such as nylon mesh, vinyl strapping, etc. Whatever materials are used for seating portion 142 and backrest portion 144, head rest 148, if included, is preferably cushioned for the occupant's comfort. Head rest 148 may be constructed with polyurethane or other suitable material in the manner commonly used for padded components of exercise equipment. Swing 100 may include an optional canopy frame 160. The canopy frame is attached to top member 110 and supports a canopy (not shown) made of canvas or another suitable material. Swing 100 may also include a table 162 attached to upright 106 for conveniently holding objects without being subjected to movement of the swing.

The fixed support structure 102 and seat support frame 120 are dimensioned so that an occupant of seat 140, with leg rest 146 in its stowed position, can comfortably rest his or her feet on the ground. This permits easy ingress to and egress from seat 140 and also allows the occupant to easily propel the swing using his or her feet against the ground.

Figure 2:
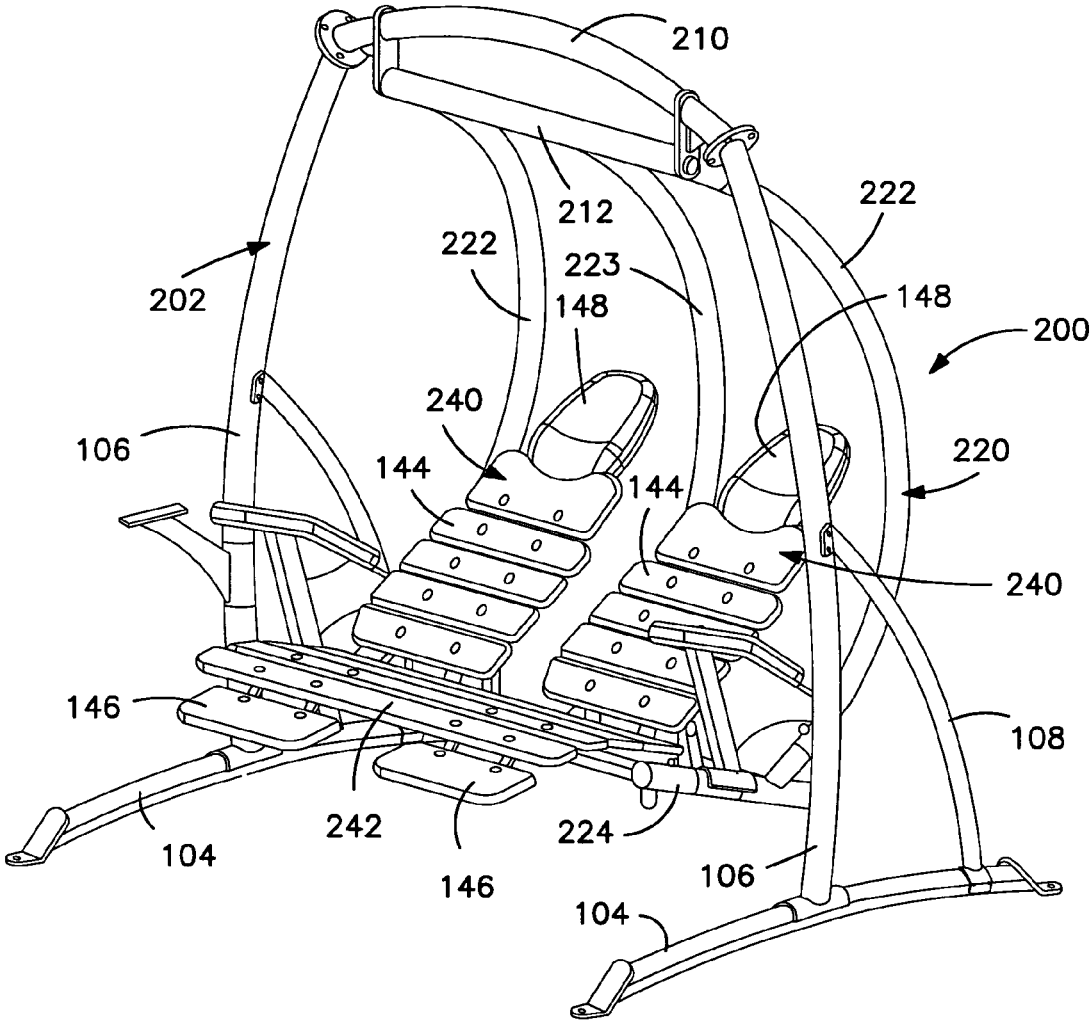
FIG. 2 is a perspective view of a second embodiment of a swing constructed in accordance with the present invention.

FIG. 2 illustrates a swing 200 similar to that previously described, but with space for two occupants. Fixed support structure 202 utilizes the same runners 104, upright members 106 and diagonal members 108 as in the previously described embodiment. A different top member 210 is used to provide the additional width necessary to accommodate the two occupants.

Seat support frame 220 is suspended from pivot assembly 212 and comprises side members 222, center member 223 and bottom frame 224. A pair of seats 240 are attached to the seat support frame. Backrest portions 144, together with head rests 148, are identical to those previously described. In this embodiment, a single seating portion 242 is common to both of the seats. However, it will be recognized that individual seating portions identical to seating portion 142 could be provided instead. Individual leg rests 146 extend forward of seating portion 242. While not shown, a canopy frame and canopy may be added to the fixed support structure 202, if desired.

Figure 3:
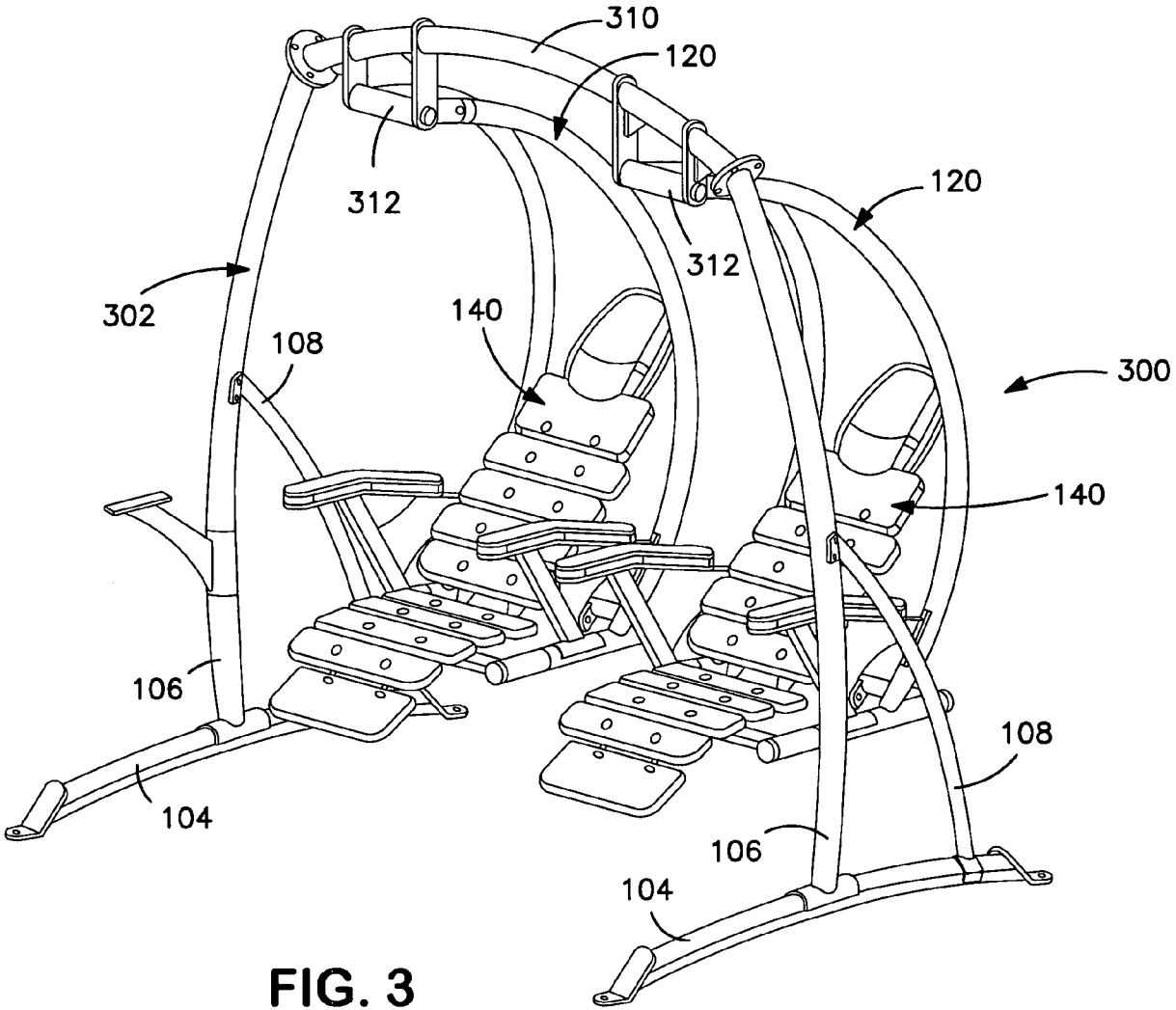
FIG. 3 is a perspective view of a third embodiment of a swing constructed in accordance with the present invention.

FIG. 3 illustrates another embodiment of a swing 300 that accommodates two occupants. In this embodiment, fixed support structure 302 again utilizes runners 104, upright members 102 and diagonal members 108. Top member 310 supports two individual pivot assemblies 312. Seat support frames 120 and seats 140 are identical to those described in connection with the embodiment illustrated in FIG. 1.

Figure 4:
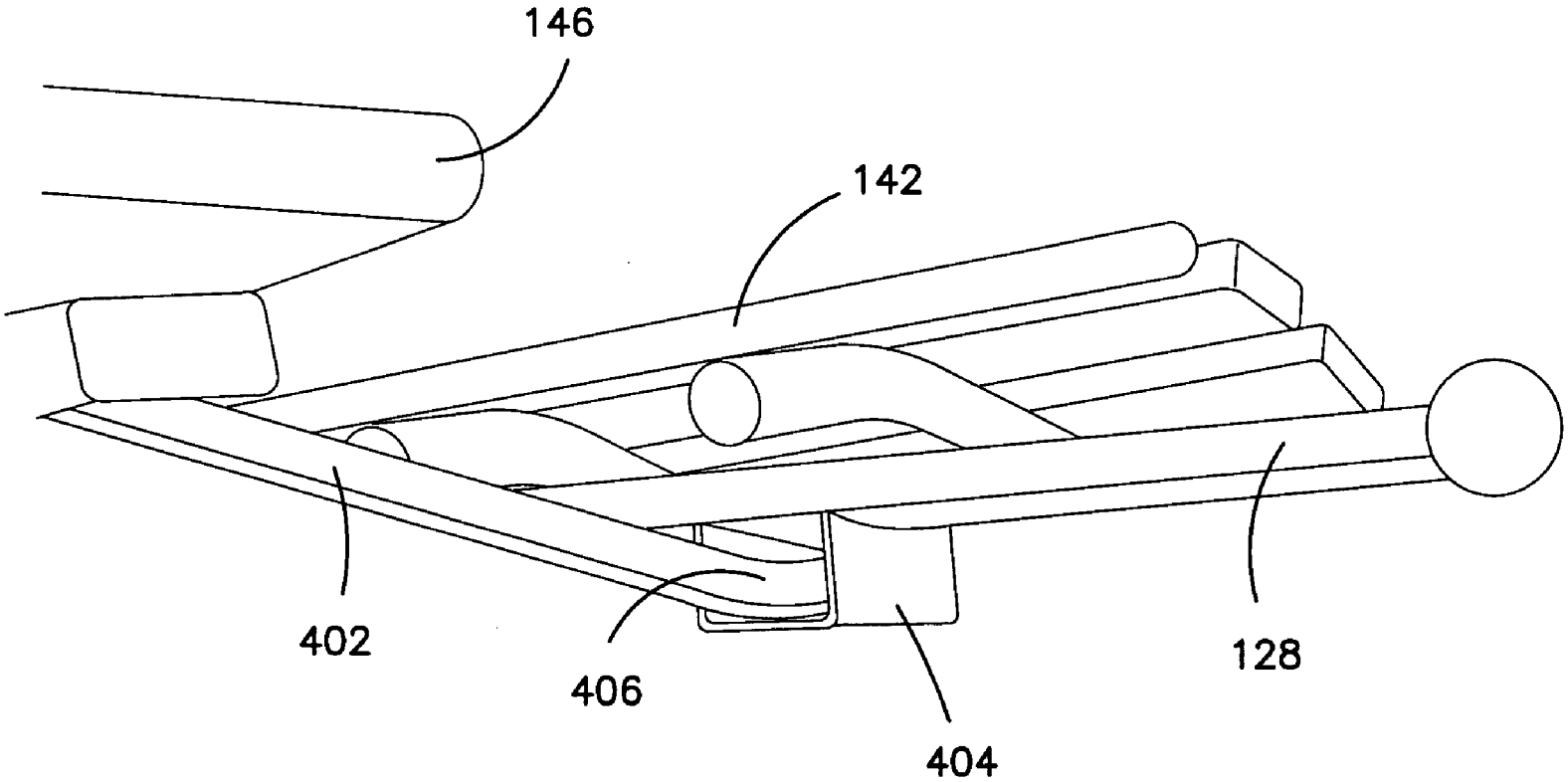
FIGS. 4 and 5 are detailed views of a leg rest assembly.

FIG. 4 is a detailed view showing leg rest 146. The leg rest is rigidly attached to an extension member 402. The extension member is carried by a sleeve 404 mounted to forward cross member 128 of the seat support frame. Sleeve 404 is preferably lined with a low friction material, such as nylon or the like, so that extension member 402 can be easily moved fore and aft. As shown in FIG. 4, leg rest 146 is in its forward, extended position. Leg rest 146 slides rearward to a stowed position beneath seating portion 142. Extension member 404 has a slight vertical curve near its rearward end 406 to permit leg rest 146 to drop below the seating portion 142 as it is moved to its stowed position.

Figure 5:
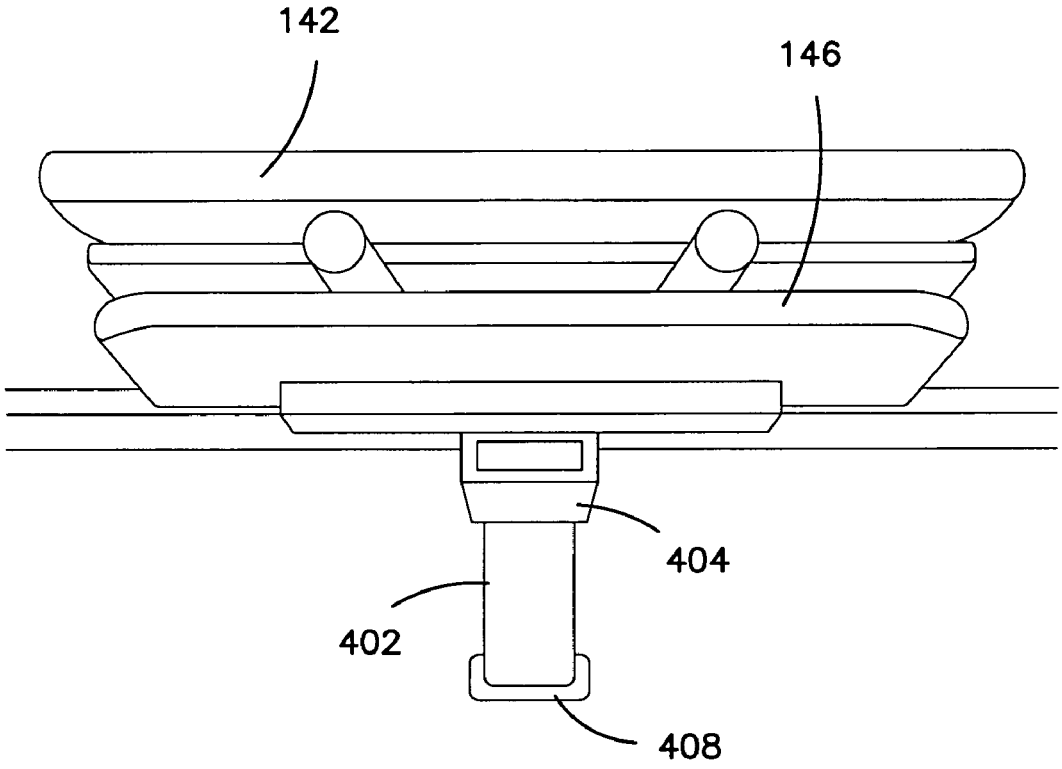

With reference now to FIG. 5, leg rest 146 is shown in its stowed position beneath seating position beneath seating portion 142. Extension member 402 is provided with a stop 408 at its extreme rearward end. Stop 408 contacts sleeve 404 to prevent leg rest 146 from being extended beyond its forward, extended position.

Figure 6:
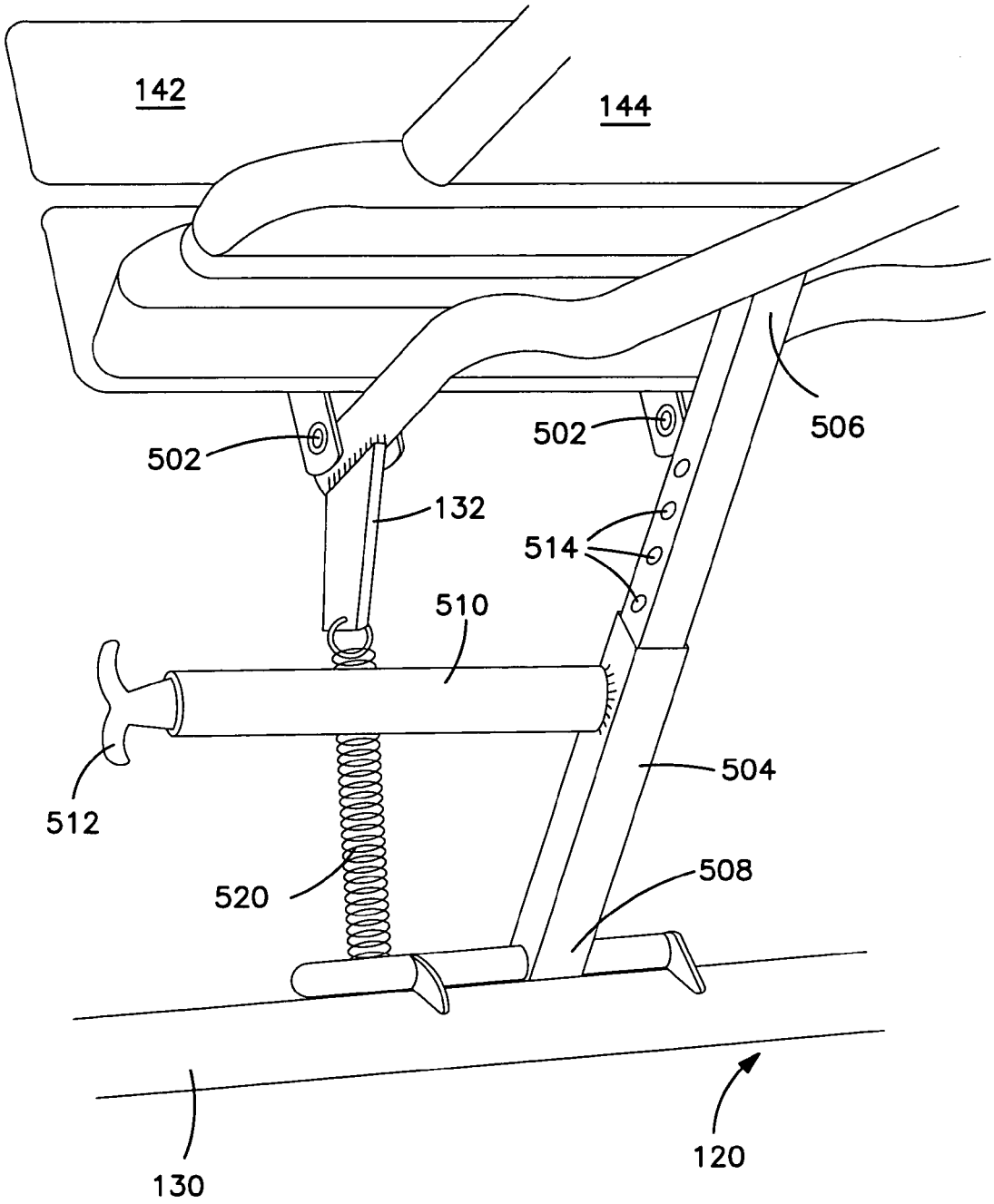
FIG. 6 is a detailed view of a backrest adjustment mechanism.
Figure 7:
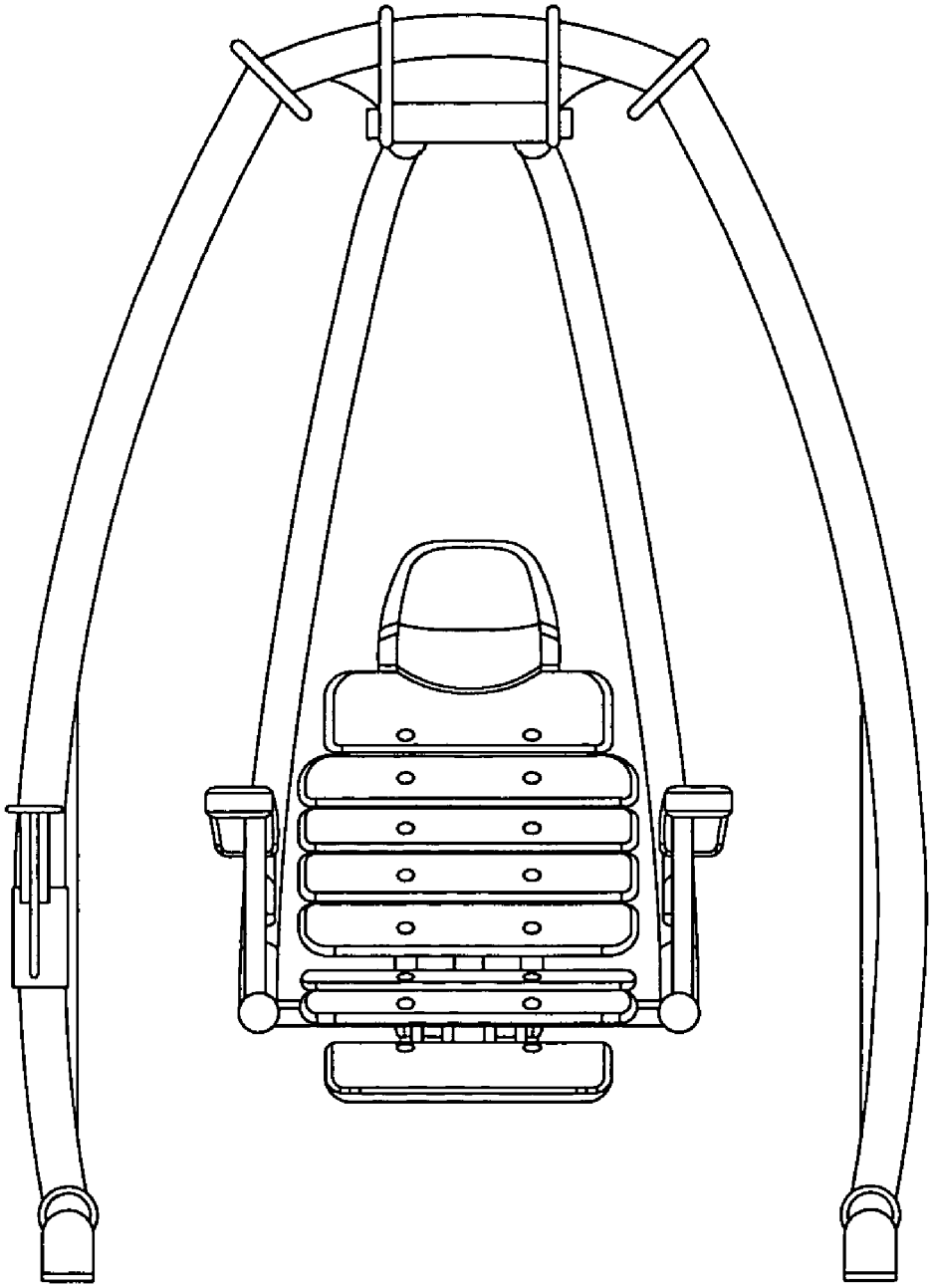
FIG. 7 is a front view of the swing of FIG. 1.
Figure 8:
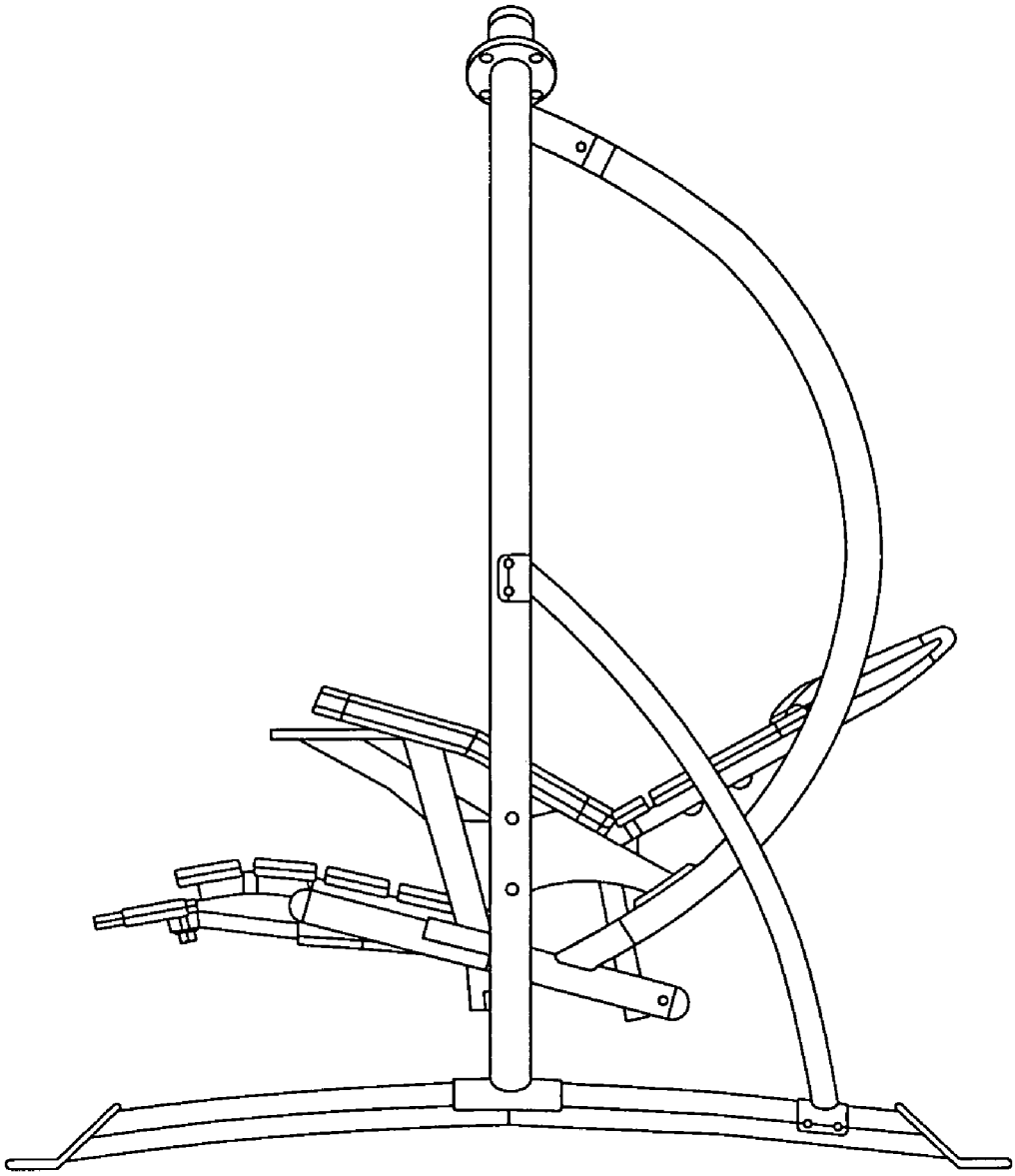
FIG. 8 is a left side view thereof, the right side being a mirror image.
Figure 9:
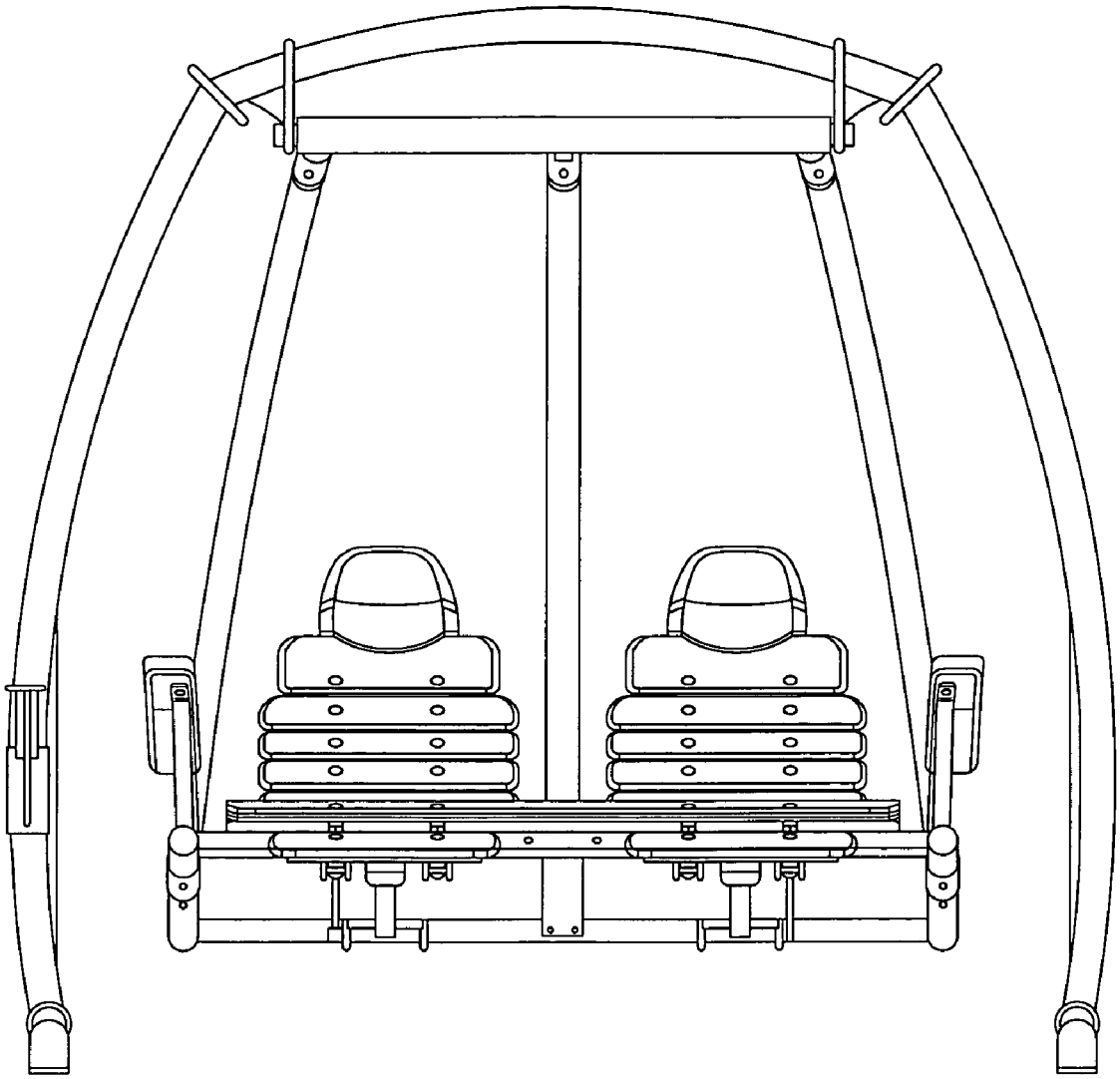
FIG. 9 is a front view of the swing of FIG. 2.
Figure 10:
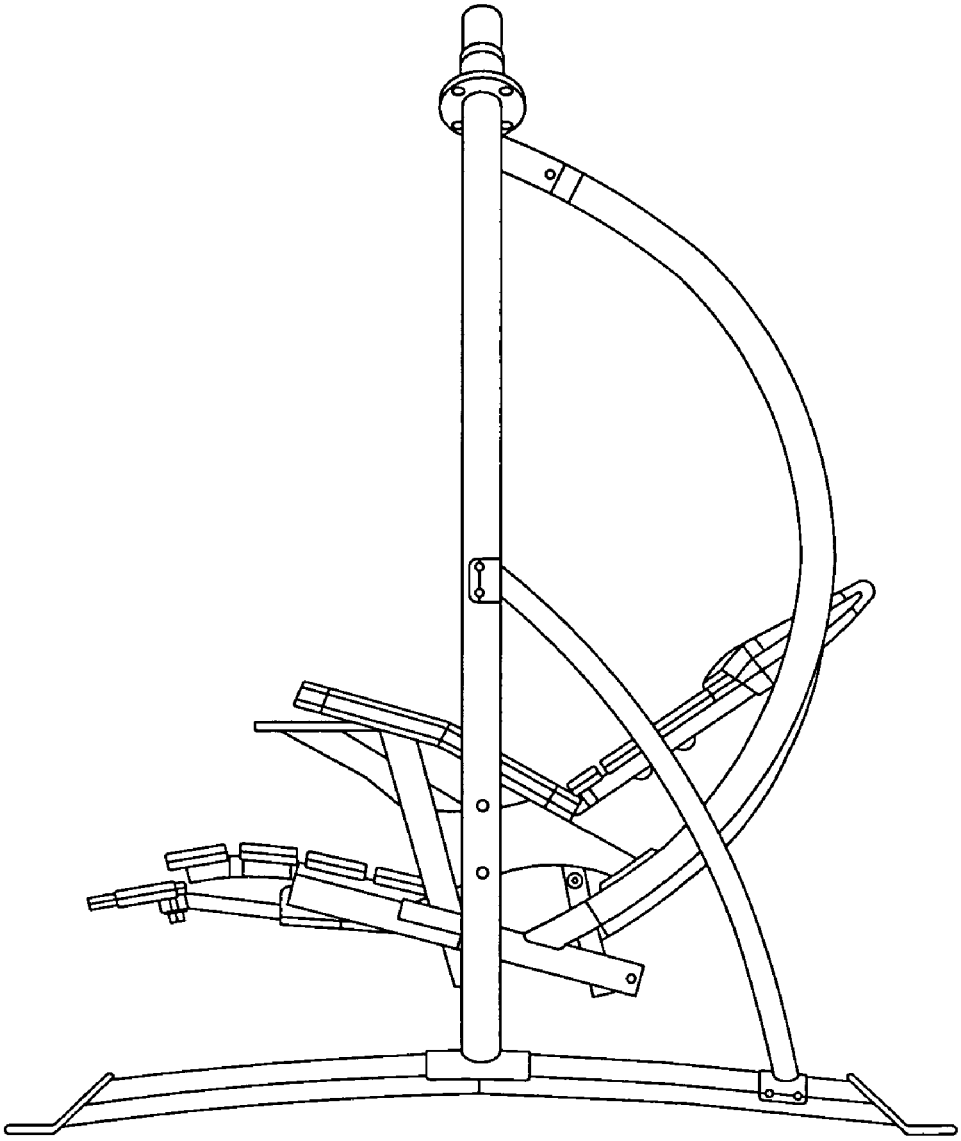
FIG. 10 is a left side view thereof, the right side being a mirror image.
Figure 11:
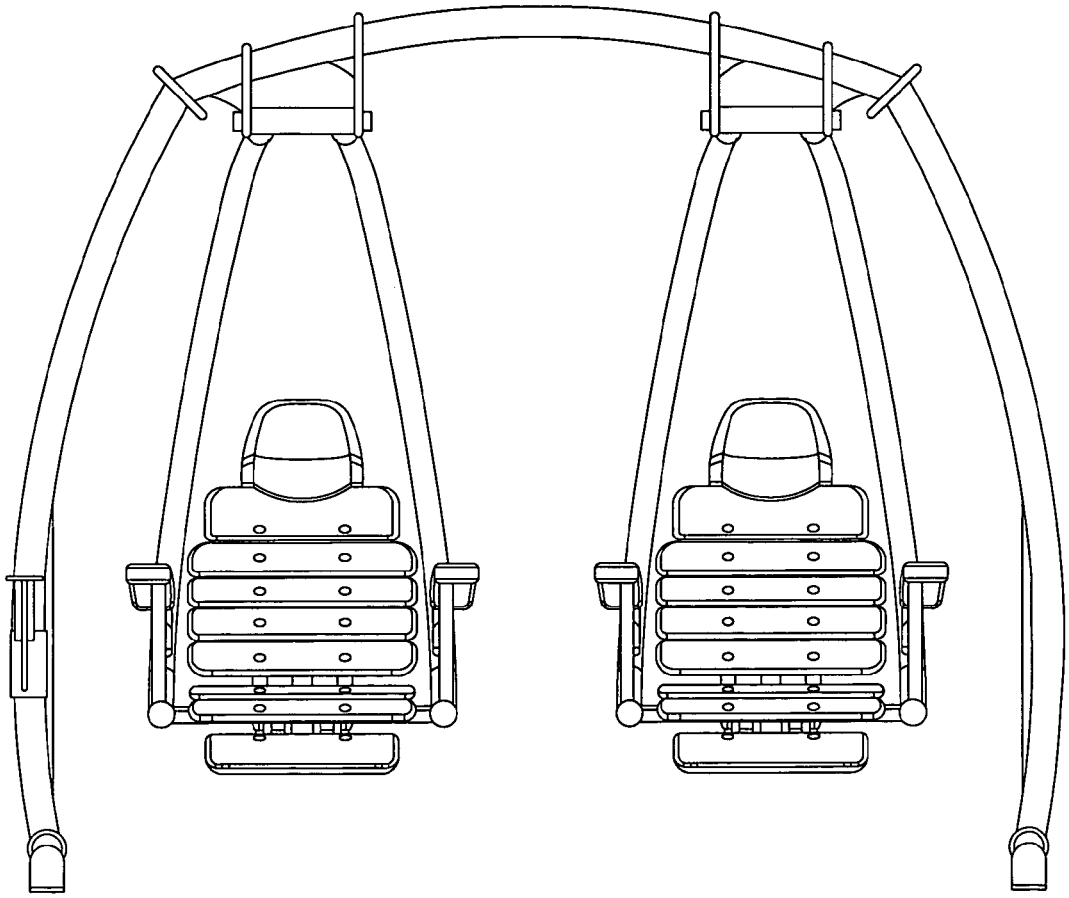
FIG. 11 is a front view of the swing of FIG. 3.
Figure 12:
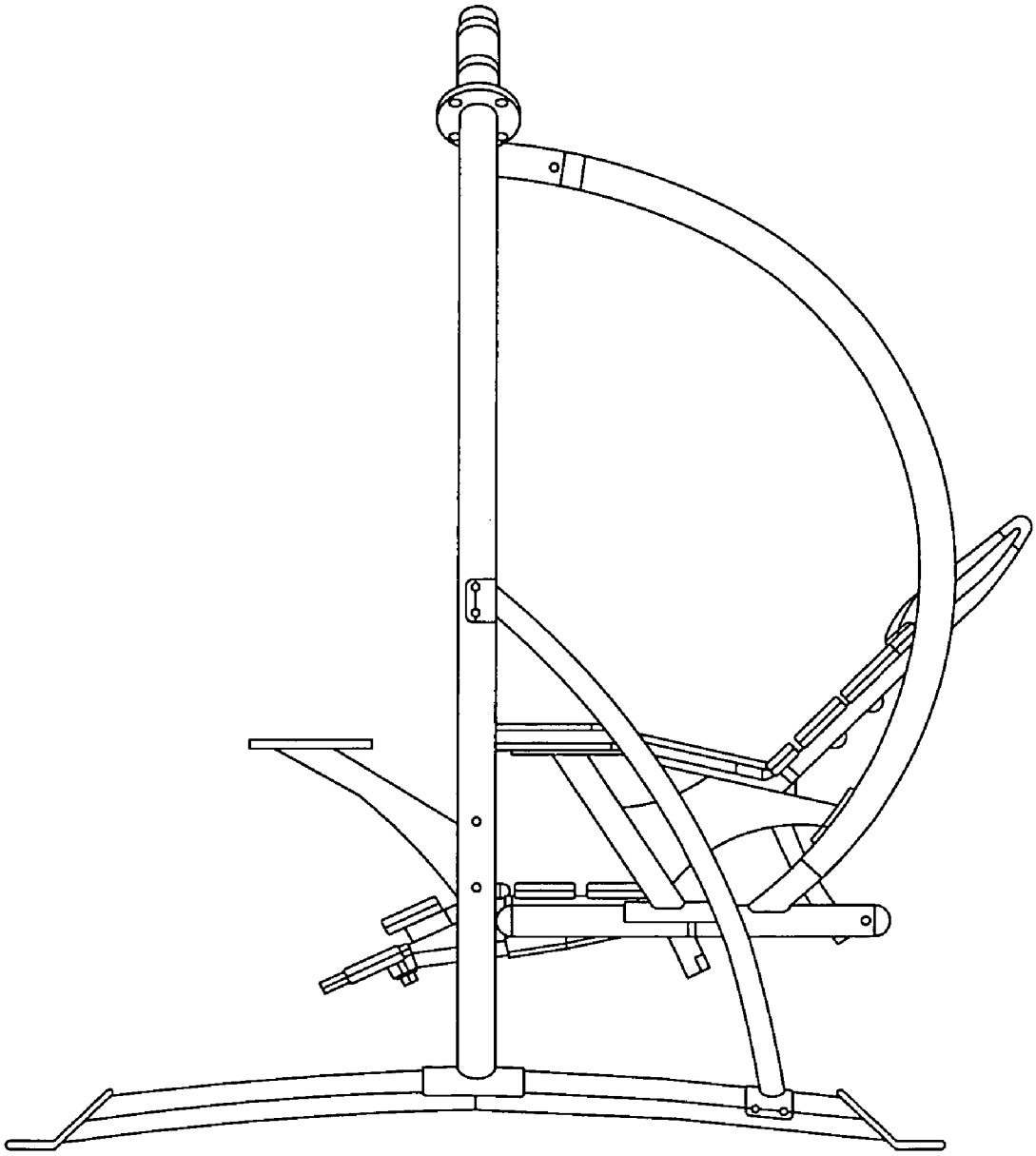
FIG. 12 is a left side view thereof, the right side being a mirror image.

FIG. 6 shows a detailed view of a backrest adjustment mechanism. Backrest 144 is pivotally attached to seat portion 142 at pivots 502. Alternatively, backrest 144 could be pivotally coupled to the seat support frame 120. A telescoping support member 504 is pivotally coupled at a first end 506 to backrest 144 and is pivotally coupled at a second end 508 to rear cross member 130 of seat support frame 120. A spring-loaded pin (not shown) is carried within tube 510 and is attached to handle 512. Tube 510 is welded or otherwise secured to the outer portion of telescoping support member 504. The pin within tube 510 engages one of a plurality of holes 514 in the inner portion of the telescoping support member. When handle 512 is pulled, the pin is withdrawn from the hole and backrest 144 may be positioned at a desired angle of recline.

Backrest 144 is biased toward an upright position by means of spring 520, which is connected between the rear cross member 130 and arm 132 attached to the backrest. An occupant of the seat can thus reach behind backrest 144 to pull handle 512 and lean forward to have the backrest assume a more upright position or lean backward to have the backrest assume a more reclined position.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A swing comprising:

a fixed support structure;

a seat support frame pivotally suspended from the support structure;

at least one seat attached to the seat support frame, the seat having a seating portion and a backrest portion;

a leg rest slideably coupled to the seat support frame so as to be moveable between a stowed position beneath the seating portion of the seat and an extended position forward of the seating portion of the seat.

2. The swing of claim 1 wherein the leg rest comprises an extension member carried by a cooperating sleeve attached to the seat support frame.

3. The swing of claim 2 wherein the extension member includes a stop at a rear end thereof.

4. The swing of claim 2 wherein the extension member is curved along at least a portion thereof.

5. A swing comprising:

a fixed support structure;

a seat support frame pivotally suspended from the support structure;

at least one seat attached to the seat support frame, the seat having a seating portion and a backrest portion;

a leg rest coupled to the seat support frame so as to be moveable between a stowed position beneath the seating portion of the seat and an extended position forward of the seating portion of the seat;

wherein the seat support frame is a first seat support frame and further comprising a second seat support frame laterally adjacent to the first seat support frame and independently pivotally suspended from the support structure.

6. A swing comprising:

a fixed support structure;

a seat support frame pivotally suspended from the support structure;

a pair of seats attached to the seat support frame, each of the seats having a seating portion and a backrest portion;

a leg rest coupled to the seat support frame so as to be moveable between a stowed position beneath the seating portion of the seats and an extended position forward of the seating portion of the seats;

wherein the seats are laterally adjacent and have a single laterally extended seating portion.

7. A swing comprising:

a fixed support structure;

a seat support frame pivotally suspended from the support structure;

at least one seat attached to the seat support frame, the seat having a seating portion and a backrest portion, wherein the backrest portion is pivotally coupled to one of the seating portion and the seat support frame;

a telescoping support member pivotally coupled at a first end to the seat support frame and at a second end to the backrest portion.

8. The swing of claim 7 further comprising means for locking the telescoping support member at a selected length, thereby locking the backrest at a selected angle of recline.

9. The swing of claim 7 further comprising means for biasing the backrest portion toward an upright position.

10. The swing of claim 9 wherein the means for biasing comprises a spring.

11. The swing of claim 7 wherein the seat support frame is a first seat support frame and further comprising a second seat support frame laterally adjacent to the first seat support frame and independently pivotally suspended from the support structure.

12. The swing of claim 7 further comprising a pair of seats coupled to the seat support frame.

13. The swing of claim 12 wherein the seats are laterally adjacent and have a single laterally extended seating portion.

14. A swing comprising:

a fixed support structure;

a seat support frame pivotally suspended from the support structure;

a pair of seats attached to the seat support frame, each of the seats having a seating portion and a backrest portion;

wherein the fixed support structure comprises left and right generally upright supports, each having a base member at a lower end thereof and a flange at an upper end thereof, and further comprises a top member having a flange at each end thereof, each of the top member flanges being attached to a respective one of the upright support flanges;

wherein the seats are laterally adjacent and have a single laterally extended seating portion.

15. A swing comprising:

a fixed support structure;

a seat support frame pivotally suspended from the support structure;

at least one seat attached to the seat support frame, the seat having a seating portion and a backrest portion, wherein the backrest portion is pivotally coupled to one of the seating portion and the seat support frame;

means for biasing the backrest portion toward an upright position;

a support member pivotally coupled to the backrest portion.

16. The swing of claim 15 further comprising means for locking the support member at a selected length, thereby locking the backrest at a selected angle of recline.

17. The swing of claim 15 wherein the means for biasing comprises a spring.

18. The swing of claim 15 wherein the seat support frame is a first seat support frame and further comprising a second seat support frame laterally adjacent to the first seat support frame and independently pivotally suspended from the support structure.

19. The swing of claim 15 further comprising a pair of seats coupled to the seat support frame.

20. The swing of claim 19 wherein the seats are laterally adjacent and have a single laterally extended seating portion.

* * * * *